US008099925B1

(12) United States Patent
Coons

(10) Patent No.: US 8,099,925 B1
(45) Date of Patent: Jan. 24, 2012

(54) CHAIR AND SYSTEM FOR POST TENSION AND PRE-STRESSED CABLE INTERSECTIONS

(76) Inventor: Wade S. Coons, Columbus, TX (US)

( * ) Notice: Subject to any disclaimer, the term of this patent is extended or adjusted under 35 U.S.C. 154(b) by 327 days.

(21) Appl. No.: 12/554,217

(22) Filed: Sep. 4, 2009

(51) Int. Cl.
*E04C 2/06* (2006.01)

(52) U.S. Cl. ..... 52/686; 52/687; 52/677; 52/719; 52/223.1; 404/136; 248/346.04

(58) Field of Classification Search ..... 52/677, 52/684, 685, 686, 687, 695, 719, 223.1, 223.14; 248/346.01, 346.03, 346.04, 346.5; 404/136
See application file for complete search history.

(56) References Cited

U.S. PATENT DOCUMENTS

| | | | | |
|---|---|---|---|---|
| 4,655,023 | A | 4/1987 | Yung | |
| 5,893,252 | A * | 4/1999 | Hardy, Jr. et al. | 52/685 |
| 6,112,494 | A * | 9/2000 | Hardy, Jr. et al. | 52/685 |
| 6,663,316 | B1 * | 12/2003 | Harris | 404/136 |
| 6,925,771 | B2 | 8/2005 | Lee et al. | |
| 7,461,491 | B1 * | 12/2008 | Sorkin | 52/685 |
| 7,469,515 | B2 * | 12/2008 | Minor | 52/719 |
| 7,506,482 | B2 * | 3/2009 | Sorkin | 52/685 |
| 2006/0188335 | A1 * | 8/2006 | Harris | 404/136 |
| 2008/0028717 | A1 * | 2/2008 | Sorkin | 52/685 |
| 2009/0120030 | A1 * | 5/2009 | Garza | 52/686 |

FOREIGN PATENT DOCUMENTS

| | | | |
|---|---|---|---|
| GB | 2139664 | A * | 11/1984 |
| GB | 2158848 | A * | 11/1985 |

* cited by examiner

*Primary Examiner* — Robert Canfield
*Assistant Examiner* — Matthew Gitlin
(74) *Attorney, Agent, or Firm* — Buskop Law Group, PC; Wendy Buskop

(57) ABSTRACT

A chair and system for securing, supporting, and connecting cable, having troughs supported on support members for receiving cables. The troughs can each have locks for closing the troughs and securing the cables in place.

15 Claims, 7 Drawing Sheets

CHAIR AND SYSTEM FOR POST TENSION AND PRE-STRESSED CABLE INTERSECTIONS

FIELD

The present embodiments generally relate to chair and system for post tension and pre-stressed cables intersections.

BACKGROUND

A need exists for a chair and system that does not allow post tension and/or pre-stressed cables to slide around once in position, since the sliding of the cables can lead to damage to the cables or damage to structures being supported or reinforced by the cables, which can lead to costly repair.

A further need exists for a chair and system that does not create a void inside or under a post tension and/or pre-stressed cable chair, since such voids can prevent materials such as concrete from filling the voids. When materials, such as wet concrete being poured, are prevented from filling the voids, the structural strength and integrity of the concrete upon drying is compromised.

A need exists for a chair and system that can be installed faster and easier, which can save money and time.

A need also exists for a chair and system that does not require "tie-wire", which can cut into post tension and/or pre-stressed cable protective sleeves and cause wear, tear and/or corrosion.

The present embodiments meet these needs.

BRIEF DESCRIPTION OF THE DRAWINGS

The detailed description will be better understood in conjunction with the accompanying drawings as follows.

Figure 2:
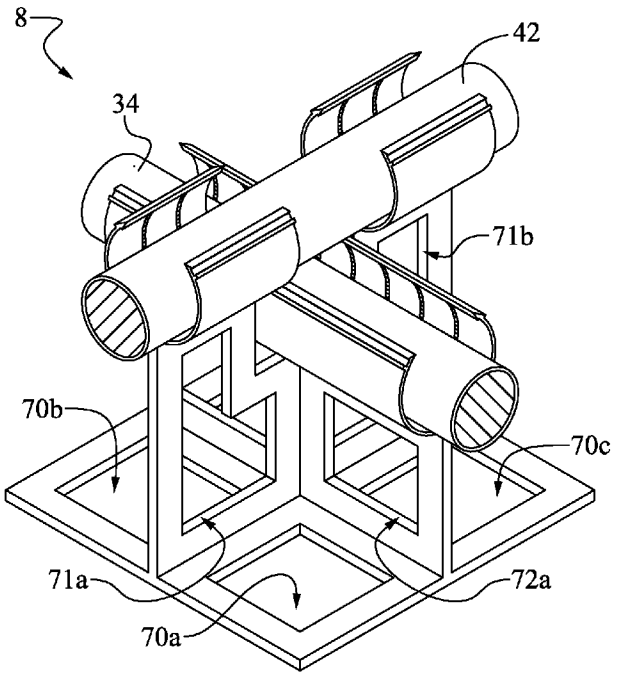
FIG. 2 depicts an alternate embodiment of the chair with cables.

The present embodiments are detailed below with reference to the listed Figures.

DETAILED DESCRIPTION OF THE EMBODIMENTS

Before explaining the present apparatus and system in detail, it is to be understood that the apparatus and system are not limited to the particular embodiments and that it can be practiced or carried out in various ways.

The present embodiments relate to a chair and system for post tension and/or pre-stressed cable intersections.

The present embodiments further relate to of chair and system for supporting and securing an intersection of two post tension and/or pre-stressed cables which are positioned over a planar surface for pouring materials, such as concrete over. The cables can be used for providing structural reinforcement and strength to the poured material. The chair can be placed on the planar surface for supporting the cables and to keep the cable above the planar surface. The chair can also be used to secure the cables in position, including securing the cables in an intersecting orientation.

Intersecting members or intersecting apparatus of the present invention can be used to secure the cables in position and in intersecting orientations, at intersections of the cables. Concrete, or other materials, can then be poured or otherwise placed over the chair and/or system for connecting cables, providing a stable, sturdy, and strong reinforced structure.

The present invention can be applied quickly and with less parts. The present invention does not require the use of tie-wires, which can lead to damage to the cables and therefore damage to any structure being supported or otherwise reinforced by the cables. The chairs and/or system can be quickly installed by simply applying pressure to troughs of the present invention or by otherwise engaging opposite grip locks, for closing over the cables and securing the cables at intersections.

The embodiments can prevent sliding of cables within the chairs, intersecting apparatus, and intersecting members by providing a tight locking engagement over the cables and in-part by providing trough ribs, which can prevent sliding of the cables with the troughs.

The present invention prevents the occurrence of voids within poured materials such as concrete, as the chair does not have spaces in which materials will not occupy when the materials are poured.

An embodiment of the system can comprise a chair for connecting post tension cable and/or pre-stressed cable. The chair can comprise a base, and the base can be adapted to rest on a support surface, which can be a planar support surface. The base can be a substantially flat structure and can be of any suitable shape or size depending upon the particular application.

The chair can comprise a first support member, which can extend upwards and from the base, and can be oriented substantially perpendicular to the base.

The chair can comprise a second support member intersecting the first support member. The second support member can extend upwards and substantially perpendicular from the base. The second support member can also be substantially perpendicular from the first support member. The second support member can have a second planar body, a first extension and a second extension, wherein both extensions can extend upwardly from the second planar body. An opening can be formed between the first and second extensions. Each support member can be a planar support member, having a substantially planar shape.

The chair can comprise a first trough disposed along a top edge of the first planar member, and can extend between the first extension and the second extension, and through the opening. The first trough can have a first trough first side and a first trough second side. It can be contemplated that the first trough can be a one-piece first trough or that the first trough can be a two-piece first trough. In the two-piece embodiment of the first trough, each piece of the first trough can be connected or not connected with each other, and can be in contact or not in contact with each other.

The first trough can be adapted to secure a first cable. The first trough can have a first trough opening along the top of the first trough and between the first trough first side and the first trough second side. The first trough first side and the first trough second side can define a first trough interior of the first trough, wherein a cable can be received.

The chair can also comprise a second trough, which can be disposed on the top edge of the first extension. The second trough can be disposed at about a ninety degree angle to the first trough. The second trough can have a second trough first side and a second trough second side.

The second trough can have a second trough opening along the top of the second trough and between the second trough first side and the second trough second side. The second trough first side and the second trough second side can define a second trough interior of the second trough, wherein a cable can be received. The second trough can be adapted to secure a second cable in the second trough, wherein the second cable can be disposed above the first cable.

The chair can also comprise a third trough, which can be disposed on the top edge of the second extension. The third trough can be disposed at about a ninety degree angle to the first trough and can be concentrically aligned with the second trough. The third trough can have a third trough first side and a third trough second side.

The third trough can have a third trough opening along the top of the third trough and between the third trough first side and the third trough second side. The third trough first side and the third trough second side can define a third trough interior of the third trough, wherein a cable can be received. The third trough can be adapted to secure the second cable in the third trough, wherein the second cable can be disposed above the first cable.

Each trough can have an upper grip lock, which can be formed on one side of each trough. Each trough can further have a lower grip lock, which can be formed on the side of each trough opposite each respective upper grip lock. The upper grip lock can engage the corresponding lower grip lock of the same trough, for holding a cable in the trough. Each grip lock can comprise a single tooth or a plurality of teeth and can extend the length of each trough or can be disposed at intervals along the length of the trough.

Each trough can have a plurality of trough ribs disposed along an interior surface of each trough. The ribs can grip each cable to prevent sliding of each cable within each trough. The ribs can also provide further structural integrity and strength to the troughs. Cables that slide can lead to a reduction in the structural integrity of any structure that is relying on the cable for structural strength and support.

In operation, the chair can be positioned on a planar support surface. The first cable can be inserted into the first trough. The first trough can be closed by engaging the first upper grip lock with the first lower grip lock. It can be contemplated that a pair of pliers or similar tool can be used to engage and apply pressure to the trough for closing the trough. The first upper grip lock tooth can engage with the first lower grip lock tooth, thereby providing a locking engagement between the teeth.

A second cable can be inserted into the second and third troughs. The second and third troughs can be closed by engaging each upper grip lock with each lower grip lock, substantially as described above with respect to the first trough. When the second cable is inserted into the second and third troughs, the second cable can be positioned in an intersecting orientation with the first cable, and can be disposed above the first cable.

The system provides a chair for connecting cables which requires no tie-wire. Tie-wire can cut into any insulation present on the outside surface of any cable that the tie-wire is tied around, which can lead to corrosion, wear and tear of the cable. Not using tie-wire can lead to a system, which can be less susceptible to corrosion, can last longer and can provide a safer, stronger, and sturdier structure.

The system further provides a chair without voids within the structure of the chair. As is evident in the embodiments, the chair comprising the first and second planar support structures and the base, does not have any three-dimensional voids.

In an embodiment, the chairs can be used to hold cables, and concrete can be poured over the chairs holding the cables, forming concrete reinforced by the cables and chairs.

It can be contemplated that a plurality of chairs can be used for connecting a plurality of cables. In an embodiment, the plurality of chairs and the plurality of cables can be arranged in a grid orientation. The plurality of cables can comprise a plurality of cables oriented in a first direction and a plurality of cables oriented in a second direction, wherein the second direction can be perpendicular to the first direction or can be at any angle from zero to about ninety degrees relative to the first direction. The grid orientation can comprise regular spacing of the chairs and cables, wherein each spacing can be of the same distance. The grid orientation can comprise irregular spacing of the chairs and cables, wherein each spacing is of various distances. The grid orientation can comprise regular alternating spacing of the chairs and cables, wherein each spacing is one of a plurality of distances, and wherein the plurality of distances of the spacing can occur in an alternating pattern.

In one embodiment each trough can further comprise at least one grip lock pressure point, which can also be called a grip point, on one or both trough sides. The grip points can be used for gripping when closing the troughs. For example, in operation, a user can grip a trough at the grip point of the trough using a pair of pliers or any other suitable tool, for closing the trough. It can be contemplated that the grip points can be gripped by hand as well.

The grip points can be formed as a member extending upwards from an exterior surface of each trough. The grip points can be formed integrally with the trough, or can be fixedly or removably attached to the trough. The grip points can be disposed proximate the upper and/or lower grip locks.

In another embodiment, the grip locks can be gripped as described above with respect to the grip points, by use of a tool or hands, for applying pressure to the trough and closing the trough. It can be contemplated that a grip point can be disposed on the trough proximate the lower grip lock, and that the grip point can be gripped while the upper grip lock is simultaneously gripped, for applying pressure and closing the trough.

In another embodiment, each support member can comprise openings. The openings can allow the chair to be formed using fewer materials.

In an embodiment, the chair can be formed as a single piece of molded plastic, however it can also be contemplated that the chair can be formed of other materials and as multiple pieces. The chair can also be formed of a resilient polymeric material or polypropylene.

In an embodiment the chair can further comprise a plurality of support bars extending from the base to each support member. The support bars can provide reinforcement and strength to the support members. The support bars can be formed integrally with the chair, or can be fixedly or removably attached to the chair.

In an embodiment, it can be contemplated that an intersecting member can be formed comprising the first and second support members, the opening and the first, second, and third troughs, as previously described above.

In an embodiment, it can also be contemplated that the intersecting member can be formed without a base as described above with respect to the chair. The present embodiment can provide a locking engagement of two intersecting cables, as described above, without a base resting on a planar support surface. However, it can be contemplated that a base can be removably or fixedly attached to a bottom edge of the first and second support members, wherein the attached base can be adapted to rest on a planar support structure. It can also be contemplated that the support members can be sized such that the support members do not make contact with any planar support surface below the support members.

In operation, the troughs of the intersecting members can be formed in substantially the same manner as the troughs of the chair, and can close in substantially the same manner as described with respect to the chair.

It can be contemplated that a system for connecting tension cable at an intersection can comprise a plurality of the chairs and a plurality of the intersecting members. In such an embodiment, the plurality of chairs, the plurality of intersecting members, and the plurality of cables can be arranged in a grid orientation. The grid orientation can comprise regular spacing of the chairs, the intersecting members and the cables, wherein each spacing can be of the same distance. The grid orientation can comprise irregular spacing of the chairs, the intersecting members and the cables, wherein each spacing can be of various distances. The grid orientation can comprise regular alternating spacing of the chairs, the intersecting members and the cables, wherein each spacing is one of a plurality of distances, and wherein the plurality of distances of the spacing can occur in an alternating pattern.

Another embodiment can further relate to a system for connecting tension cable at intersections, which can comprise a chair substantially as described above, as well as an intersecting apparatus.

The chair can comprise a base, first, second, and third troughs, first and second support members, an opening, first and second cables and upper and lower grip locks as described above. The chair can further have a plurality of trough ribs in each of the troughs, as described above.

The intersecting apparatus can comprise a first half and a second half. The first half can be hingedly connected to the second half. The first half and the second half can be formed as an integral piece, or can be fixedly or removably attached.

The first half can comprise a first intersecting trough having a first intersecting trough first side and a first intersecting trough second side for receiving a cable.

The first half can further have a second intersecting trough, which can be integrally connected at about a right angle to the first intersecting trough first side for receiving a cable.

The first half can have a third intersecting trough, which can be integrally connected at about a right angle to the first intersecting trough second side and opposite the second intersecting trough for additionally receiving the cable received by the second intersecting trough.

The second half can comprise a fourth intersecting trough, which can have a fourth intersecting trough first side and a fourth intersecting trough second side. The fourth intersecting trough can be for locking the cable that is received by the second and third intersecting troughs.

The second half can have a fifth intersecting trough, which can be integrally connected at about a right angle to the fourth intersecting trough first side for locking over the cable received by the first intersecting trough.

The second half can have a sixth intersecting trough, which can also be integrally connected at a right angle to the fourth intersecting trough second side, opposite the fifth intersecting trough, for locking over the cable received by the first intersecting trough.

The first half can be adapted to lock over the second half for securely fixing the intersecting cables received in the intersecting troughs. Each trough of the first half can have inner grip locks disposed along an interior of each trough of the first half. Each trough of the second half can have outer grip locks disposed along an exterior of each trough of the second half, such that the inner grip locks of the first half can engage the out grip locks of the second half, thereby locking the intersecting apparatus over the cables. Alternatively the first half troughs can have outer grip locks and the second half troughs can have inner grip locks. When the inner grip locks of one trough engage over the outer grip locks of another trough, a locking engagement between the two grip locks is achieved.

The intersecting apparatus and the chair can be made of an impact resistant, high durometer material, resilient polymeric material, polypropylene, or combinations thereof. It can be contemplated that the chair and the intersecting apparatus can be made of any suitable material depending upon the particular application, and are not limited to being made of the particular materials herein described.

The intersecting apparatus can be formed as a single molded piece, however it can also be contemplated that the intersecting apparatus can be formed as multiple pieces. The intersecting apparatus can be formed by injection molding, however it can be contemplated that the intersecting apparatus can be formed by any suitable process.

The present system can further comprise at least one hinge for connecting the first half to the second half. The hinge can be formed of a flexible material, such as a flexible polymer, or the hinge can be formed of the same material as the intersecting apparatus. The hinge can further be formed as an integral part of the intersecting apparatus.

The present system can comprise a plurality of chairs and a plurality of intersecting apparatus, wherein each chair and each intersecting apparatus locks onto at least two cables. In an embodiment, the plurality of chairs, the plurality of intersecting apparatus, and the plurality of cables can be arranged in a grid orientation. The grid orientation can comprise regular spacing of the chairs, the intersecting apparatus, and the cables, wherein each spacing can be of the same distance. The grid orientation can comprise irregular spacing of the chairs, the intersecting apparatus, and the cables, wherein each spacing can be of various distances. The grid orientation can comprise regular alternating spacing of the chairs, the intersecting apparatus, and the cables, wherein each spacing can be one of a plurality of distances, and wherein the plurality of distances of the spacing can occur in an alternating pattern.

In operation, a cable can be inserted into the fourth intersecting trough. Another cable can be inserted into the fifth and sixth intersecting troughs, such that the cable inserted into the fifth and sixth intersecting troughs is in an intersecting orientation with respect to the cable inserted into the fourth intersecting trough. The first half can be folded over using the hinge, such that the first half is disposed above the second half.

When the first half is disposed over the second half, the first intersecting trough can lock onto the fifth and sixth intersecting troughs by interlocking the outer grip locks of the first intersecting trough with the inner grip locks of the fifth and sixth intersecting troughs. Alternatively, the fifth and sixth intersecting troughs can have outer grip locks for interlocking with an inner grip lock disposed on the first trough.

When the first half is disposed over the second half, the second and third intersecting troughs can lock onto the fourth intersecting trough by interlocking the outer grip locks of the second and third intersecting troughs with the inner grip lock of the fourth intersecting trough. Alternatively, the second and third intersecting troughs can have inner grip locks for interlocking with an outer grip lock of the fourth intersecting trough. The intersecting apparatus can thereby secure an intersection of two cables.

Figure 1:
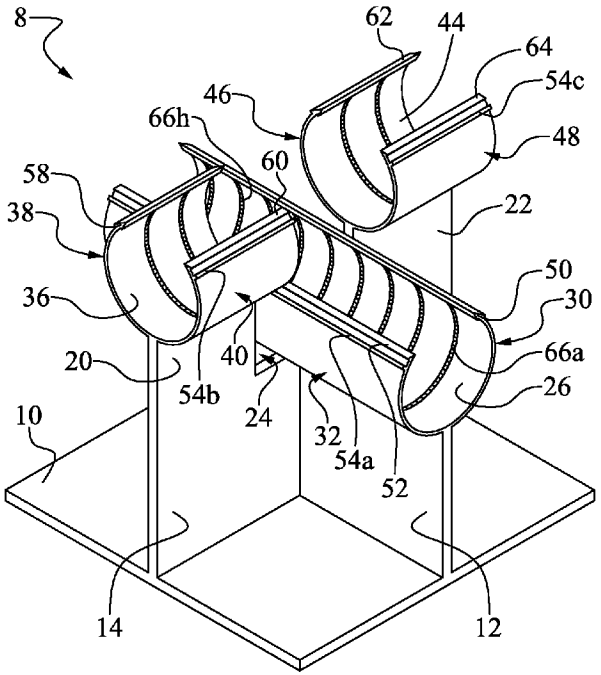
FIG. 1 depicts an embodiment of the chair.

Turning now to FIG. 1, which depicts a chair 8 having a base 10. A first support member 12 and a second support member 14 are depicted extending upwards from the base 10. The second support member 14 can be perpendicular to the first support member 12. Each support member can be a planar support member, having a substantially planar shape. The second support member 14 is depicted with first extension 20 and second extension 22. An opening 24 is depicted disposed between the first extension 20 and the second extension 22.

The chair 8 is depicted having a first trough 26 disposed on the first support member 12, extending between the first extension 20 and the second extension 22, and through the opening 24. The first trough 26 is shown with a first trough first side 30 and a first trough second side 32.

The chair 8 is depicted having a second trough 36 disposed on the first extension 20. The second trough 36 is shown with a second trough first side 38 and a second trough second side 40.

The chair 8 is depicted having a third trough 44 disposed on the second extension 22.

The third trough 44 is shown with a third trough first side 46 and a third trough second side 48.

The first trough 26 is depicted with a first upper grip lock 50 disposed along the first trough first side 30. The first trough 26 is further depicted with a first lower grip lock 52 disposed along the first trough second side 32. It can be contemplated that the upper and lower grip locks can each be disposed along the opposite trough side.

A second upper grip lock 58 and a second lower grip lock 60 are depicted along the second trough first side 38 and second trough second side 40. A third upper grip lock 62 and a third lower grip lock 64 are depicted disposed on the third trough first side 46 and the third trough second side 48.

A plurality of trough ribs are depicted along the interior of each trough for providing slip resistance and structural support, however, only trough ribs 66*a* and 66*h* are shown.

Each trough is also depicted comprising a first grip point 54*a*, 54*b*, and 54*c*.

FIG. 2 depicts an alternate embodiment of the chair with cables. However, the chair 8 is depicted with a plurality of opened areas disposed within the base 10. Only opened areas 70*a*, 70*b*, 70*c* are depicted in this Figure.

The chair 8 is also depicted with opened areas 71*a* and 71*b* disposed in the second support member 14. The chair 8 is depicted with opened area 72*a* disposed in the first support member 12. A corresponding opened area can be disposed on the opposite side of first support 12, which is not shown in this Figure.

FIG. 2 further shows a first cable 34 disposed within the first trough 26, and a second cable 42 disposed within the second and third troughs 36 and 44. In this embodiment, the second cable 42 is disposed above the first cable 34, and the cables are in an intersecting orientation with respect to each other.

Figure 3:
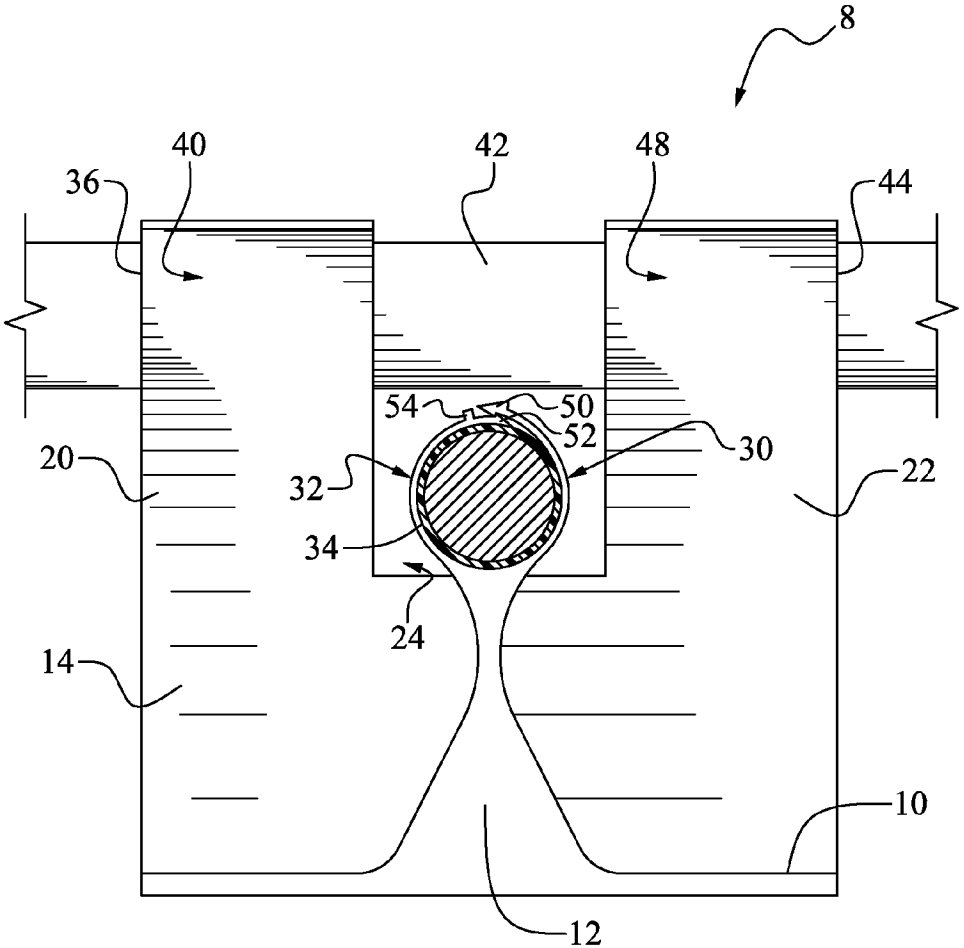
FIG. 3 depicts a side view of an embodiment of the present chair with cables.

FIG. 3 is a side view of an embodiment of the chair 8, wherein the base 10 is depicted with the first support member 12 extending upwards therefrom. The second support member 14 is depicted extending upwards from the base 10 perpendicular to the first support member 12. The first extension 20 and second extension 22 are also depicted.

The first trough first side 30 and the first trough second side 32 are shown engaged in a closed position with the first cable 34 disposed within both first trough sides, thereby securing the first cable 34 into position. The first upper grip lock 50 of the first trough first side 30 is shown engaged with the lower grip lock 52 of the first trough second side 32. The first grip point 54 is depicted disposed on the first trough second side 32.

The second trough 36 with the second trough second side 40 and the third trough 44 with the third trough second side 48 are shown with the second cable 42 received within each.

Figure 4B:
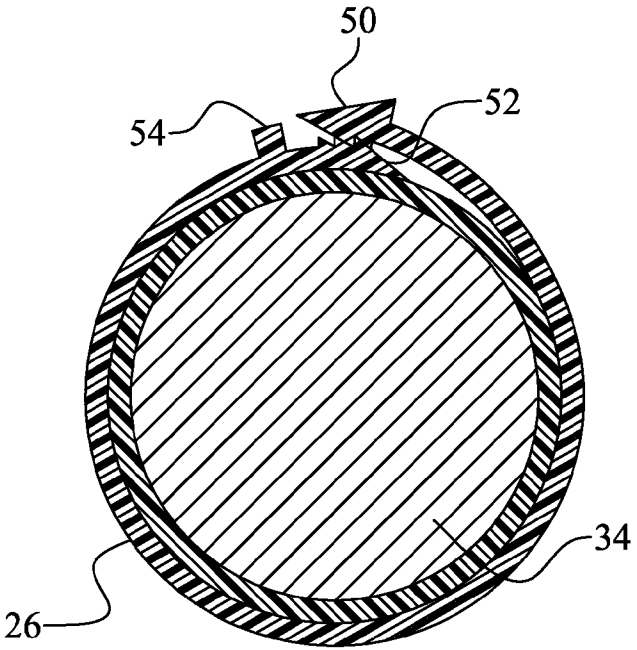
FIG. 4B depicts a trough with a cable, with the trough in a closed position.
Figure 4A:
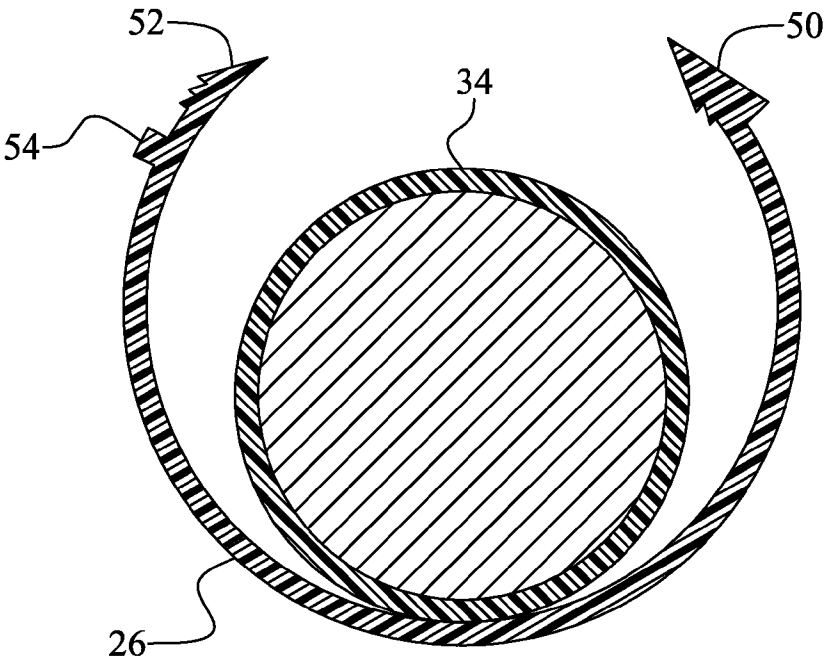
FIG. 4A depicts a trough with a cable, with the trough in an open position.

FIG. 4A shows the first trough 26 in an open position with the first cable 34 disposed within the first trough 26. The first trough 26 is shown having a first upper grip lock 50, a first lower grip lock 52, and a first grip point 54. In this embodiment, the grip locks are shown with a plurality of teeth.

FIG. 4B shows the first trough 26 in a closed position, with the first cable 34 disposed with the first trough 26. The first trough 26 is shown with the first upper grip lock 50 engaged over the first lower grip lock 52 such that the first upper grip lock 50 is locked in place over the first lower grip lock 52. It can be seen in this Figure that the first cable 34 is securely positioned within the first trough 26. T The embodiments described in FIGS. 4A and 4B are not limited to the first trough or the first cable 34. It can be contemplated that any troughs of the present invention can be formed and can function in the same or substantially the same manner.

Figure 5A:
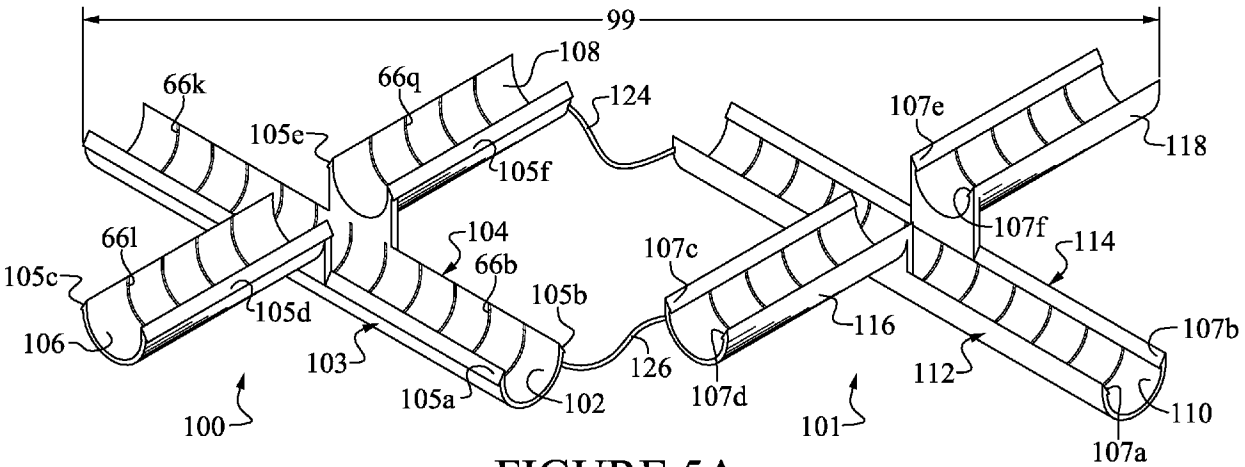
FIG. 5A depicts an intersecting apparatus in an open position.

FIG. 5A depicts the intersecting apparatus 99 in an open position with a first half 100 and a second half 101.

The first half 100 has a first intersecting trough 102, with a first intersecting trough first side 103 and a first intersecting trough second side 104. A second intersecting trough 106 is depicted disposed on the first intersecting trough first side 103, perpendicular to the first intersecting trough 102. A third intersecting trough 108 is depicted disposed on the first intersecting trough second side 104, perpendicular to the first intersecting trough 102, and concentrically aligned with the second intersecting trough 106.

The second half 101 is depicted with a fourth intersecting trough 110 having a fourth intersecting trough first side 112 and a fourth intersecting trough second side 114. A fifth intersecting trough 116 is depicted disposed on the fourth intersecting trough first side 112, perpendicular to the fourth intersecting trough 110. A sixth intersecting trough 118 is depicted disposed on the fourth intersecting trough second side 114 and concentrically aligned with the fifth intersecting trough 116.

Each intersecting trough of the intersecting apparatus 99 is depicted with a plurality of trough ribs, however, only trough ribs 66*b*, 66*k*, 66*l*, and 66*q* are shown in this Figure.

The first half 100 is shown connected to the second half 101 with a first hinge 124 and a second hinge 126. The hinges allow the first half 100 and the second half 101 to remain connected before use, and allow the second half 101 to be folded over the first half 100 for securing cables.

The intersecting troughs of the first half 100 are depicted, each having outer grip locks 105*a*, 105*b*, 105*c*, 105*d*, 105*e*, 105*f*. The intersecting troughs of the second half 101 are depicted, each having inner grip locks 107*a*, 107*b*, 107*c*, 107*d*, 107*e*, 107*f*. In operation, the second half 101 can be closed over the first half 100 such that the inner grip locks 107*a*, 107*b*, 107*c*, 107*d*, 107*e*, 107*f* of the second half 101 engage the outer grip locks 105*a*, 105*b*, 105*c*, 105*d*, 105*e*, 105*f*, providing a locking engagement between the first half 100 and the second half 101, and securing any cable or cables disposed within the intersecting troughs of the intersecting apparatus 99.

Figure 5B:
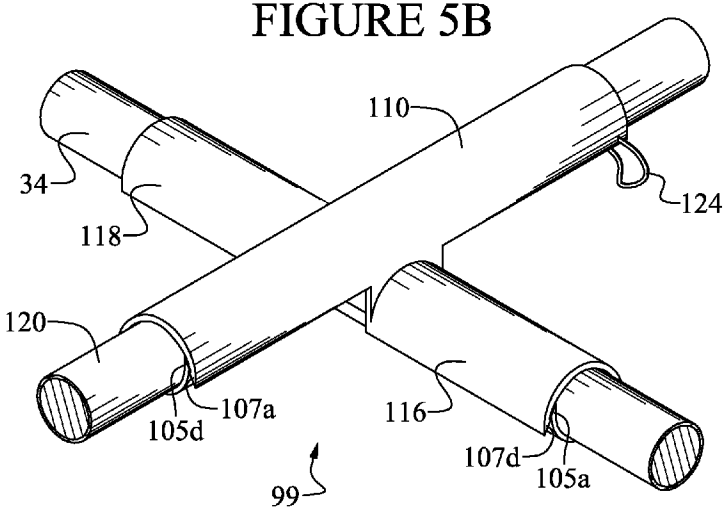
FIG. 5B depicts an intersecting apparatus in a closed position.

FIG. 5B depicts the intersecting apparatus 99 in a closed position. The second half 101 is depicted folded over the first half 100. Fourth intersecting trough 110, fifth intersecting trough 116 and sixth intersecting troughs 118 can be seen engaged over the top of the first half 100. The outer grip locks 107*a* and 107*d* can be seen engaged with the inner grip locks 105*d* and 105*a*, providing a locking engagement between the first half 100 and the second half 101. First cable 34 and third cable 120 are depicted secured within the closed intersecting apparatus 99.

Figure 6:
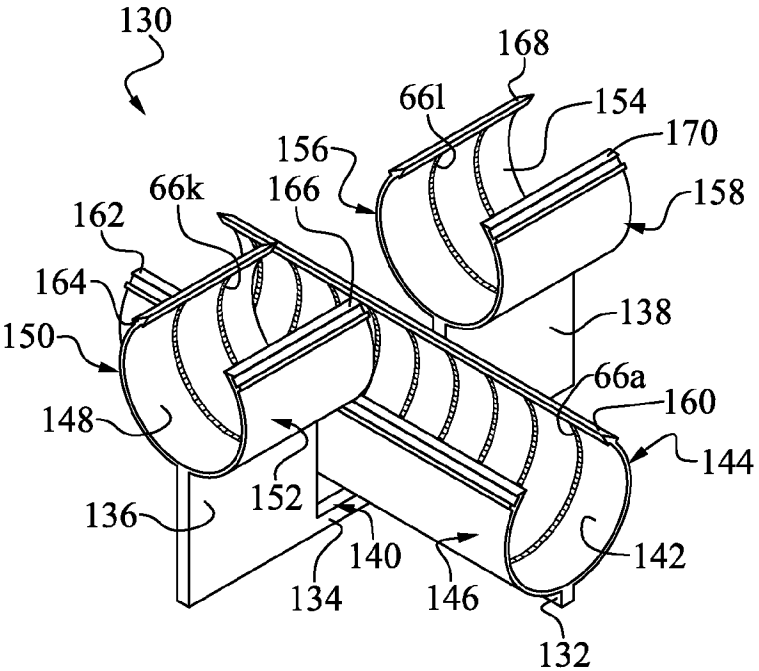
FIG. 6 depicts an intersecting member.

FIG. 6 shows the intersecting member 130 having a third support member 132 which intersects with a fourth support member 134. The fourth support member 134 has a third extension 136 and a fourth extension 138. A second opening 140 is depicted formed between the third extension 136 and the fourth extension 138. Each support member can be a planar support member, having a substantially planar shape.

A fourth trough 142 is shown disposed on the third support member 132, having a fourth trough first side 144 and a fourth trough second side 146.

A fifth trough 148, with a fifth trough first side 150 and a fifth trough second side 152, is depicted disposed on the third extension 136. Similarly, a sixth trough 154 is shown disposed on the fourth extensions 138, having a sixth trough first side 156 and a sixth trough second side 158.

A fourth upper grip lock 160 is shown disposed on the fourth trough first side 144. A fourth lower grip lock 162 is shown disposed on the fourth trough second side 146. The fourth upper grip lock 160 can engage the fourth lower grip lock 162 for closing the fourth trough 142.

A fifth upper grip lock 164 is shown disposed on the fifth trough first side 150. A fifth lower grip lock 166 is shown disposed on the fifth trough second side 152. The fifth upper grip lock 164 can engage the fifth lower grip lock 166 for closing the fifth trough 148.

A sixth upper grip lock 168 is shown disposed on the sixth trough first side 156. A sixth lower grip lock 170 is shown disposed on the sixth trough second side 158. The sixth upper grip lock 168 can engage the sixth lower grip lock 170 for closing the sixth trough 154.

Each of the troughs is depicted with a plurality of trough ribs, however, only trough ribs 66*a*, 66*k*, and 66*l* are shown in this Figure.

Figure 7:
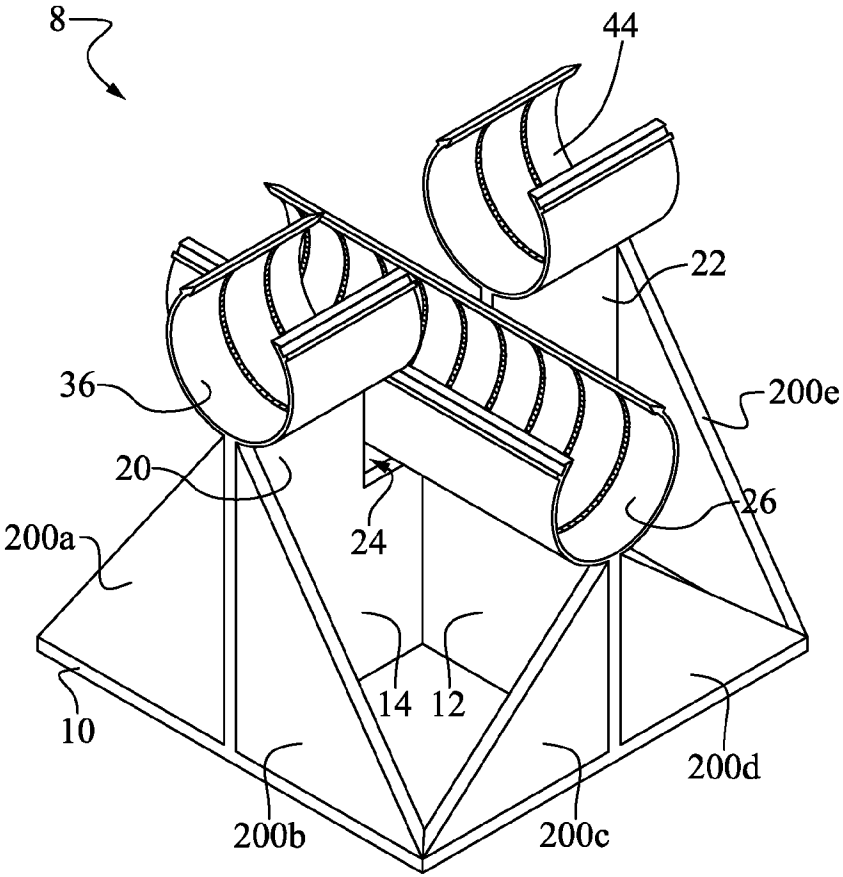
FIG. 7 depicts a chair with support bars.

FIG. 7 depicts a chair with support bars 200*a*-200*e*. The support bars are depicted as substantially triangular in shape, each extending from the base to a support member. However, it can be contemplated that the support bars can be any shape.

Figure 8:
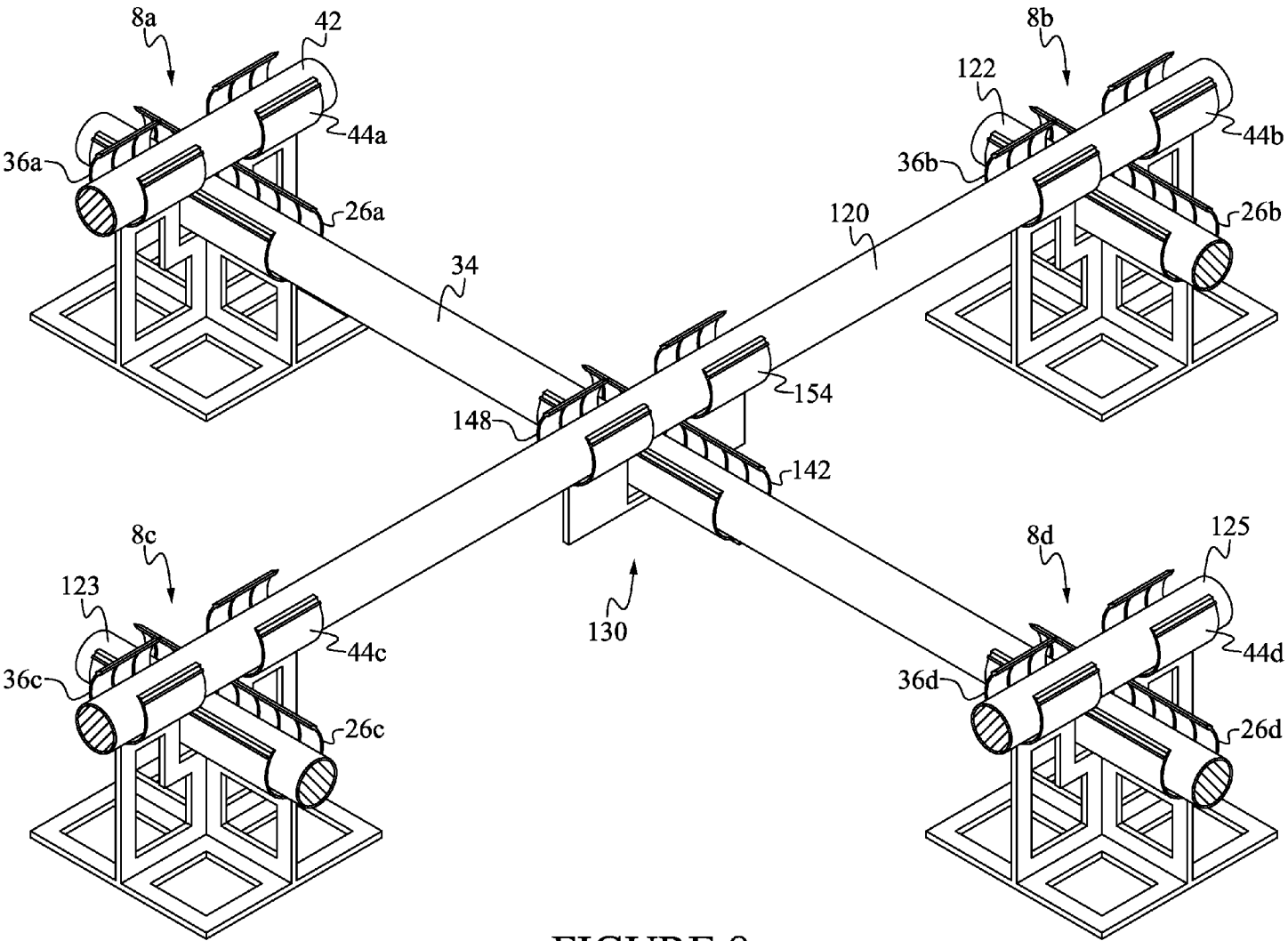
FIG. 8 depicts a system for connecting cables.

FIG. 8 depicts an embodiment of the system for connecting post tension cable or pre-stressed cable at intersections is depicted with a first cable 34, a second cable 42, a third cable 120, a fourth cable 122, a fifth cable 123 and a sixth cable 125.

A plurality of chairs 8*a*, 8*b*, 8*c*, 8*d* are depicted in this Figure. The second cable 42 is depicted within the second trough 36*a* and the third trough 44*a* of one of the plurality of chairs 8*a*. The first cable 34 is shown extending from the one chair 8*a* towards the intersecting member 130. The first cable 34 extends further to engage within the first trough 26*d* of the chair 8*d*. The fourth cable 122 is depicted within the first trough 26*b* of another of the plurality of chairs 8*b*. The fifth cable 123 is depicted within the first trough 26*c* of another of the plurality of chairs 8*c*. The sixth cable 125 is depicted within the second trough 36*d* and the third trough 44*d* of another of the plurality of chairs 8*d*.

The first cable 34 is shown disposed within the fourth trough 142 of the intersecting member 130. Furthermore, the third cable 120 is depicted disposed within the fifth trough 148 and the sixth trough 154 of the intersecting member 130. The third cable is depicted within the second trough 36*c* and third trough 44*c* of the chair 8*c*, as well as the second trough 36*b* and third trough 44*b* of the chair 8*b*. In this Figure only four chairs 8*a*, 8*b*, 8*c*, 8*d* are depicted and one intersecting member 130 is shown, however, it can be contemplated that a plurality of each of the chairs 8*a*, 8*b*, 8*c*, 8*d* and the intersecting member 130 can be utilized in a system for connecting post tension cable or pre-stressed cable at intersections.

Figure 9:
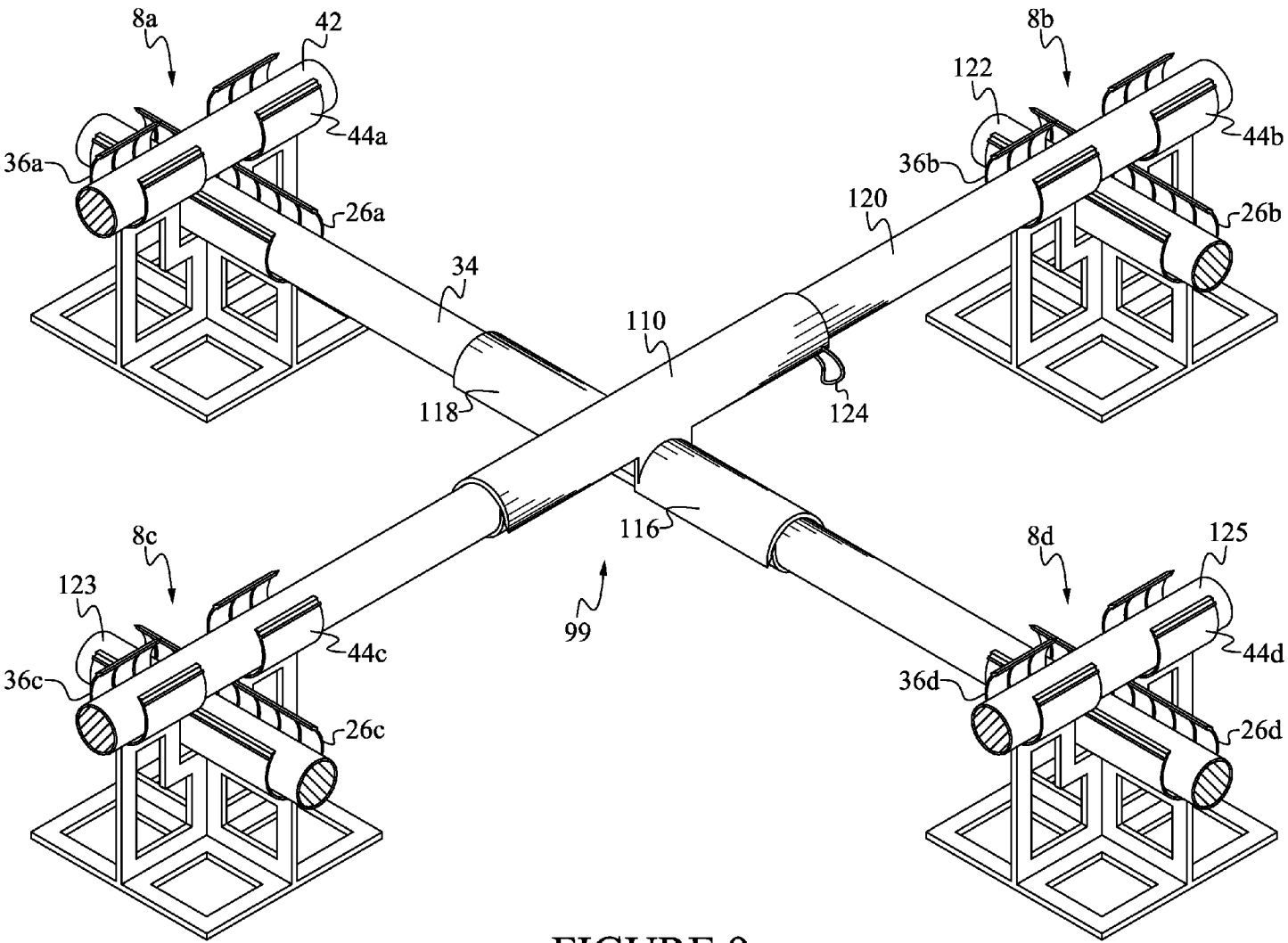
FIG. 9 depicts an alternate system for connecting cable.

FIG. 9 shows an embodiment of the system for connecting post tension cable or pre-stressed cable at intersections with a first cable 34, a second cable 42, a third cable 120, a cable fourth 122, a cable fifth 123 and a sixth cable 125. In the embodiment the intersecting apparatus 99 is shown in a closed position.

A plurality of chairs 8*a*. 8*b*, 8*c*, 8*d* are depicted in this Figure. The second cable 42 is depicted within the second trough 36*a* and the third trough 44*a* of the chair 8*a*. The first cable 34 is shown extending from the first trough 26*a* of chair 8*a* towards the intersecting apparatus 99. The first cable 34 is shown disposed within the fifth intersecting trough 116 and the sixth intersecting trough 118, and is also disposed within the first intersecting trough 102, not shown in this FIG. 8. The first cable 34 further extends into the first trough 26*d* of chair 8*d*.

Furthermore, a third cable 120 is depicted disposed within fourth intersecting trough 110, and is also disposed within the second intersecting trough 106 and the third intersecting troughs 108, also not shown in this Figure. The third cable is also disposed within the second trough 36*c* and the third 44*c* trough of chair 8*c*, as well as the second trough 36*b* and the third trough 44*b* of chair 8*b*.

The fourth cable 122 is depicted disposed within the first trough 26*b* of chair 8*b*. The fifth cable 123 is depicted disposed within the first trough 26*c* of the chair 8*c*. The sixth cable 125 is depicted disposed within the second trough 36*d* and the third trough 44*d* of chair 8*d*.

While these embodiments have been described with emphasis on the embodiments, it should be understood that within the scope of the appended claims, the embodiments might be practiced other than as specifically described herein.

What is claimed is:

1. A system for connecting post tension cable or pre-stressed cable at intersections comprising:

a. a chair comprising:

i. a base adapted to rest on a surface;

ii. a first support member intersecting with a second support member extending from the base, wherein the second planar support member has a first extension and a second extension, and wherein an opening is formed between the first extension and the second extension;

iii. a first trough having a first trough first side and a first trough second side disposed on the first support member between the first extension and the second extension and wherein the first trough is adapted to secure a first cable;

iv. a second trough having a second trough first side and a second trough second side disposed on the first extension at a 90 degree angle to the first trough and wherein the second trough is adapted to secure a second cable in the second trough;

v. a third trough having a third trough first side and a third trough second side disposed on the second extension at a 90 degree angle to the first trough; wherein the third trough is adapted to secure the second cable; wherein the second cable is disposed above the first cable and further wherein the first cable and the second cable are in an intersecting relationship with each other;

vi. a first upper grip lock formed in the first trough first side for engaging a first lower grip lock formed in the first trough second side for closing the first trough;

vii. a second upper grip lock formed in the second trough first side for engaging a second lower grip lock formed in the second trough second side for closing the second trough; and viii. a third upper grip lock formed in the third trough first side for engaging a third lower grip lock in the third trough second side for closing the third trough;

b. an intersecting apparatus comprising:

i. a first half hingedly connected to a second half, wherein the first half 100 comprises:

a first intersecting trough having a first intersecting trough first side and a first intersecting trough second side for receiving the first cable;

a second intersecting trough integrally connected at a right angle to the first intersecting trough side for receiving a third cable;

a third intersecting trough integrally connected at a right angle to the second intersecting trough side and opposite the first intersecting trough for receiving the third cable; and outer grip locks disposed on each side of each of the first, second, and third intersecting troughs;

ii. wherein the second half comprises:

a fourth intersecting trough having a fourth intersecting trough first side and a fourth intersecting trough second side for receiving the third cable;

a fifth intersecting trough integrally connected at a right angle to the fourth intersecting trough first side for receiving the first cable;

a sixth intersecting trough integrally connected at a right angle to the fourth intersecting trough second side for receiving the first cable; and inner grip locks disposed on each side of each of the fourth, fifth, and sixth intersecting troughs;

wherein the inner grip locks disposed on the second half engage the outer grip locks disposed on the first half, for locking the first half to the second half.

2. The system of claim 1, further comprising a plurality of trough ribs disposed on an interior of each trough.

3. The system of claim 1, wherein the intersecting apparatus, the first trough, the second trough, and the third trough are made of an impact resistant, high durometer material.

4. The system of claim 1, wherein the intersecting apparatus is a molded one piece apparatus made of resilient polymeric material.

5. The system of claim 1, wherein the intersecting apparatus is substantially made of polypropylene and is one piece injection molded.

6. The system of claim 1, further comprising a first hinge, a second hinge, or combinations thereof, for connecting the first half to the second half.

7. A chair for connecting post tension cable or pre-stressed cables comprising:

a. a base adapted to rest on a surface;

b. a first support member intersecting with a second support member extending from the base, wherein the second support member has a first extension and a second extension, and an opening formed between the first and second extensions;

c. a first trough having a first trough first side and a first trough second side disposed on the first support member between the first extension and the second extension and wherein the first trough is adapted to secure a first cable;

d. a second trough having a second trough first side and a second trough second side disposed on the first extension at a 90 degree angle to the first trough and wherein the second trough is adapted to secure a second cable in the second trough;

e. a third trough having a third trough first side and a third trough second side disposed on the second extension at a 90 degree angle to the first trough and wherein the third trough is adapted to secure the second cable;

f. a first upper grip lock formed in the first trough first side for engaging a first lower grip lock formed in the first trough second side for closing the first trough;

g. a second upper grip lock formed in the second trough first side for engaging a second lower grip lock formed in the second trough second side for closing the second trough; and h. a third upper grip lock formed in the third trough first side for engaging a third lower grip lock in the third trough second side for closing the third trough.

8. The chair of claim 1, wherein the first trough is a two-piece first trough.

9. The chair of claim 1, further comprising a plurality of trough ribs disposed on an interior of each of the troughs for prevent sliding of each cable within each trough.

10. The chair of claim 1, wherein each trough comprises at least one first grip point on the first side of each trough, at least one second grip point on the second side of each trough, or combinations thereof.

11. The chair of claim 1, wherein the base and each support member each comprise at least one opened area.

12. The chair of claim 1, wherein the chair is formed as a one piece molded plastic.

13. The chair of claim 1, further comprising a plurality of support bars extending from the base to one of the support members.

14. The chair of claim 13, wherein the chair is substantially made of polypropylene.

15. The chair of claim 1, wherein the chair is made of a resilient polymeric material.

* * * * *